US006526765B2

(12) United States Patent
Lifson

(10) Patent No.: US 6,526,765 B2
(45) Date of Patent: Mar. 4, 2003

(54) PRE-START BEARING LUBRICATION SYSTEM EMPLOYING AN ACCUMULATOR

(75) Inventor: Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 124 days.

(21) Appl. No.: 09/742,638

(22) Filed: Dec. 22, 2000

(65) Prior Publication Data

US 2002/0078697 A1 Jun. 27, 2002

(51) Int. Cl.[7] ..... F25B 43/02
(52) U.S. Cl. ..... 62/84; 62/468; 62/471
(58) Field of Search ..... 62/84, 468, 471

(56) References Cited

U.S. PATENT DOCUMENTS 5,672,054 A * 9/1997 Cooper et al. ..... 418/63
5,761,914 A * 6/1998 Carey et al. ..... 62/84
5,868,001 A * 2/1999 Shoulders ..... 62/503
5,947,710 A * 9/1999 Cooper et al. ..... 418/63
6,202,437 B1 * 3/2001 Yun ..... 62/503
6,257,840 B1 * 7/2001 Ignatiev et al. ..... 417/310
6,263,694 B1 * 7/2001 Boyko ..... 62/468

* cited by examiner

*Primary Examiner*—William C. Doerrler
*Assistant Examiner*—Mark Shulman

(57) ABSTRACT

Just before shutdown, or at least prior to a significant pressure equalization in a refrigeration system, an accumulator containing oil is isolated from the rest of the refrigeration system in such a way that oil is at a pressure that is higher than the pressure of the rest of the system. The oil in the accumulator is maintained in a state of higher pressure while the refrigeration system is shutdown with the aid of a spring-loaded piston. Preliminary to start up of the refrigeration system, the pressurized oil is placed in fluid communication with structure requiring lubrication which is thereby lubricated.

7 Claims, 2 Drawing Sheets

PRE-START BEARING LUBRICATION SYSTEM EMPLOYING AN ACCUMULATOR

BACKGROUND OF THE INVENTION

Some components of refrigeration compressors are supported by bearings. To achieve reliable operation for long periods of time, bearings, and other compressor components, require lubrication by a lubricant with adequate viscosity. In a refrigeration system, this is provided by the use of a suitable oil. After long periods of compressor non-operation, oil can completely drain from the bearings. If the compressor is started after such a period, the bearings, and or other components, will operate for some period of time with no lubricant, causing metal-to-metal contact between parts . This can result in wear, ultimately shortening the useful life of the compressor. Additionally, in some compressor refrigeration systems, the pressure differential between compressor compartments may be used to develop lubrication flows. In such systems, some time may be required after initial start up to develop pressure differences adequate for establishing lubrication flows. During this time, there is no delivery of oil to the bearings and other components, thereby resulting in their wear.

One method of accomplishing lubrication, shortly before and/or during start up, is by the use of a positive displacement pump (with suitable piping) which is activated prior to start up, thereby drawing lubricant from an oil reservoir and delivering it to the bearings and other components. A positive displacement pump used for this purpose adds its own reliability risk as well as substantial cost. The pump can be of substantial size because it may be required to deliver a significant amount of oil to provide an adequate amount of lubrication to the bearings and other components of the compressor.

SUMMARY OF THE INVENTION

Prior to shutdown, pressurized oil, or oil-rich oil-refrigerant solution is isolated from the rest of the refrigeration system in a dedicated accumulator. The isolated oil is at a pressure that is higher than the pressure existing in the bearing cavities and other components at the time of start up and is maintained at this higher pressure by applying a preload on a spring acting on a piston so as to form a spring-driven piston. The spring is preloaded by a pressure differential acting across the piston which is established prior to compressor shutdown. Accumulator pressure loss and accompanying loss of spring preload can occur due to the long term effects of leakage across the piston face and valves during long periods of compressor shutdown. To alleviate this problem, a small, positive displacement pump can be added to the system solely for preloading the spring by delivering pressurized oil to the side of the piston opposite the spring and thereby pressurizing the accumulator chamber acting against the spring.

Preliminary to restarting the refrigeration system, the state of isolation of this pressurized oil is ended by placing the oil in fluid communication with the bearings and possibly other components to be lubricated. Flow of the oil results by virtue of its pressure being higher than the pressure at the bearings and other components as the oil is being expelled from the accumulator by the spring driven piston, thereby accomplishing pre-start lubrication.

It is an object of this invention to provide lubrication shortly before and/or during start up using a pre-charged fluid reservoir.

It is another objective of this invention is to provide and enhance lubrication of compressor components shortly before and/or during start up using a small, inexpensive pump in combination with a pre-charged fluid reservoir.

It is a further object of this invention to provide a method and apparatus for lubrication delivery prior to and/or during start up that is compatible with the normal operation of the lubrication system. These objects, and others as will become apparent hereinafter, are accomplished by the present invention.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
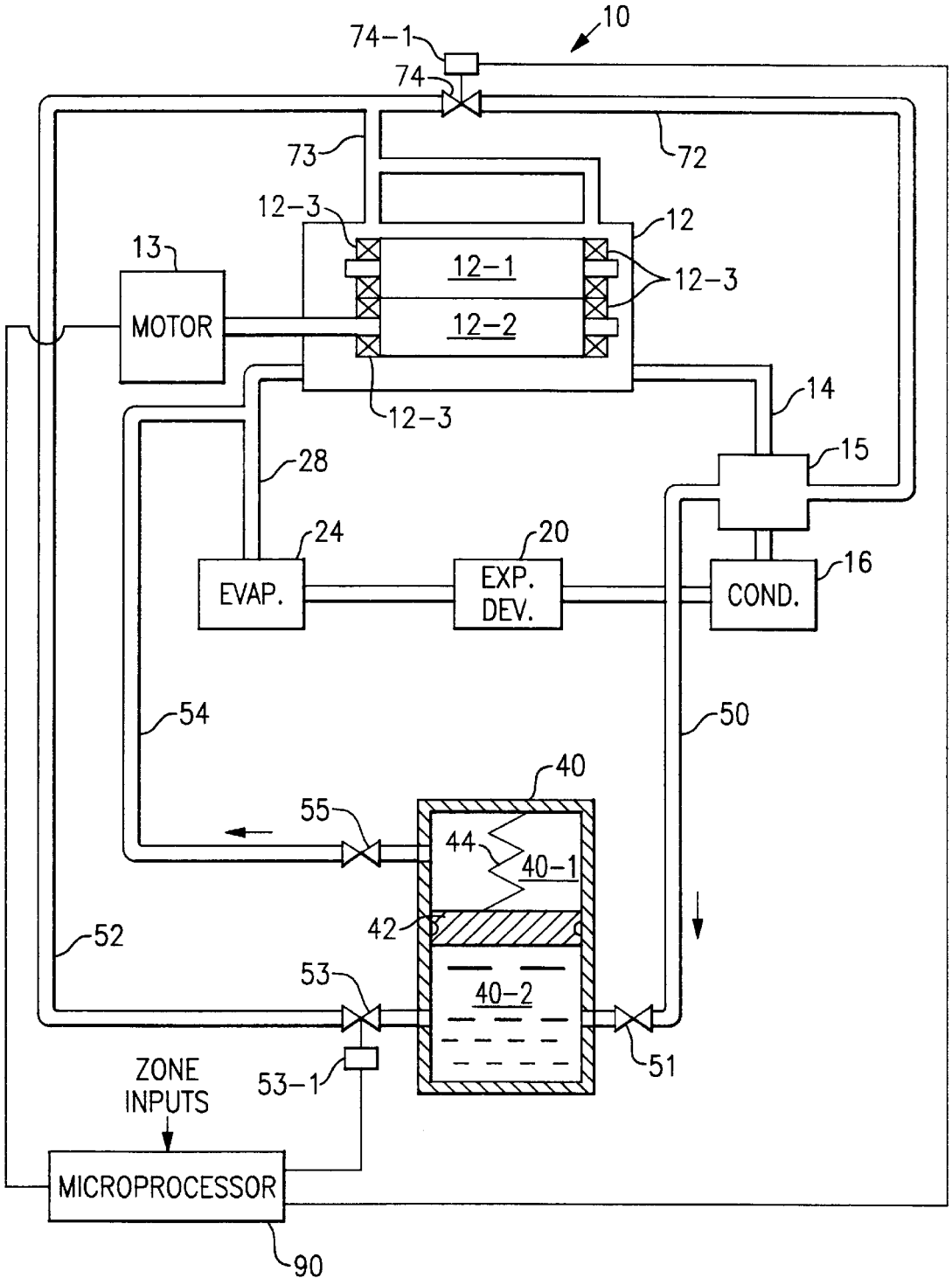
FIG. 1 is a schematic representation of a refrigeration system employing a first embodiment of the present invention.

In FIG. 1, the numeral 10 generally designates a refrigeration system. Refrigeration system 10 includes a positive displacement compressor 12 which is illustrated as a screw compressor having screw rotors 12-1 and 12-2 which are supported at their ends by a plurality of suitable bearings 12-3. Refrigeration system 10 includes a fluid circuit serially including screw compressor 12, discharge line 14, oil separator 15, condenser 16, expansion device 20, evaporator 24, and suction line 28. Screw compressor 12 is driven by motor 13 under the control of microprocessor 90.

Compressor lubrication systems can vary somewhat in their layout and working function.

Accumulator 40 is dedicated to pre-start lubrication and is divided into two chambers, 40-1 and 40-2, respectively, by piston 42. As pistons, diaphragms and bellows are equivalents, the piston 42 may be replaced by a diaphragm or bellows as where long time shutting down of the system 10 would result in leakage across piston 42. Accumulator chamber 40-2 is connected to oil separator 15 via line 50 which contains one-way valve 51. Oil separator 15 is at or close to discharge pressure during compressor operation. The valve 51 allows the flow of oil into chamber 40-2 from oil separator 15, but not out of this chamber. The chamber 40-2 is connected by line 52 to line 73 for injecting oil via line 73 into, and thereby lubricating, the screw compressor components such as bearings 12-3 prior to starting compressor 12. Line 72 connects oil separator 15 to line 73 for injecting oil into screw compressor 12 to provide lubrication to compressor 12 and components such as bearings 12-3 when it is operating. Solenoid valve 74 is located in the line 72 under the control of microprocessor 90 which can open or close the solenoid 74-1 of solenoid valve 74 to permit or prevent oil flow from oil separator 15 to compressor 12. Accumulator chamber 40-2 is serially connected via line 52 which contains solenoid valve 53 and line 73 to bearings 12-3 and other components that require lubrication. Solenoid valve 53 is controlled by microprocessor 90 by opening and closing solenoid 53-1. Spring 44 is located in chamber 40-1 and tends to bias piston 42 towards chamber 40-2. The one-way valve 51 allows movement of oil into the chamber 40-2, but not out of this chamber. Accumulator chamber 40-1 is connected to the suction side of system 10 via line 54 which contains optional one-way valve 55. When used, valve 55 allows movement of refrigerant vapor out of chamber 40-1, but not into the chamber and this assures the establishment of the greatest pressure differential across piston 42 experienced during operation. This is desired because under some operating conditions there is a very small pressure differential between suction and discharge and would be unsuitable to preload spring 40. Alternatively, chamber 40-1 can be connected to some intermediate location in the system 10 where the pressure is below discharge pressure.

In operation of refrigeration system 10, gaseous refrigerant is drawn via suction line 28 into compressor 12 where it is compressed. The resultant, hot high pressure refrigerant gas is discharged from the compressor 12 and then supplied via discharge line 14 to oil separator 15 where a substantial amount of oil mist entrained in the hot, high pressure refrigerant gas is separated out and collected. Hot, high pressure gas then passes to condenser 16. In condenser 16, the gaseous refrigerant condenses as it gives up heat due to heat transfer via air, water or brine-cooled heat exchangers (not shown). The condensed refrigerant passes through expansion device 20 thereby undergoing a pressure drop and partially flashing as it passes into evaporator 24. In evaporator 24, the remaining liquid refrigerant evaporates due to heat transfer via air, water or brine-cooled heat exchangers (not shown). The gaseous refrigerant is then supplied via suction line 28 to compressor 12 to complete the cycle. During operation, as oil is separated from discharging gaseous refrigerant by oil separator 15, it can pass to chamber 40-2 through oil flow line 50 and one-way valve 51 if it is at a higher pressure than the pressure which exists in chamber 40-2.

Solenoid valve 74 is kept open during normal compressor operation allowing oil from the oil separator 15 to be injected back into the compressor via lines 72 and 73 for lubrication of screw compressor components such as bearings 12-3. During normal compressor operation, solenoid valve 53 is closed and the pressurized oil can be delivered from oil separator 15 to the chamber 40-2 if the pressure in the oil separator 15 is higher than the pressure in chamber 40-2. Thus, the pressure in chamber 40-2 is at the highest discharge pressure seen by compressor 12 during its normal operating cycle. If oil from oil separator 15 is supplied to chamber 40-2, that causes the piston 42 to be displaced into the chamber 40-1. As piston 42 is displaced into chamber 40-1, the pressure in chamber 40-1 tends to rise with the decreasing volume. When pressure in chamber 40-1 exceeds the pressure on the other side of one-way valve 55, refrigerant vapor is exhausted from chamber 40-1. Thus, the pressure in chamber 40-1 is the lowest suction pressure seen by compressor 12 during its normal operation. Movement of piston 42 into chamber 40-1 pre-loads the spring 44.The spring 44 is compressed until the spring pre-load is balanced by the pressure forces acting on the piston 42 in chambers 40-1 and 40-2. This pressure force is equal to the pressure differential across the piston face multiplied by the area of the piston. The spring pre-load is maximized as one-way valve 55 assures that chamber 40-1 is maintained at the lowest suction pressure and one-way valve 51 assures that chamber 40-2 is maintained at the highest discharge pressure seen by the compressor 12 during its operation.

After the compressor 12 is shutdown, the solenoid valve 53 remains closed, while the one-way valve 55 prevents inflow of vapor into the chamber 40-1, thus maintaining the same low pressure in chamber 40-1 as existed before the compressor shutdown. At the same time, the one-way valve 51 prevents outflow of oil from chamber 40-2, thus maintaining the same high pressure in chamber 40-2 as before the compressor shutdown. This effectively makes accumulator 40 a pressure tight vessel with high pressure in chamber 40-2 and low pressure in chamber 40-1.

After the compressor shutdown, the solenoid valve 74 is closed to prevent short-circuiting of oil from chamber 40-2 into the oil separator 15, thus assuring that the oil will be delivered into the compressor bearings 12-3 and not into the oil separator 15. With the solenoid valve 74 closed, the solenoid valve 53 is opened at a predetermined time prior to the compressor start up. The opening of the solenoid valve 53 results in a drop in the pressure in chamber 40-2. The drop in pressure in chamber 40-2 causes a reduction of the pressure differential across the piston 42, this causes the preloaded spring 44 to displace the piston 42 towards chamber 40-2 expelling the oil out of chamber 40-2 into the line 52 and then line 73 to lubricate the screw compressor bearings 12-3 and other components.

Figure 2:
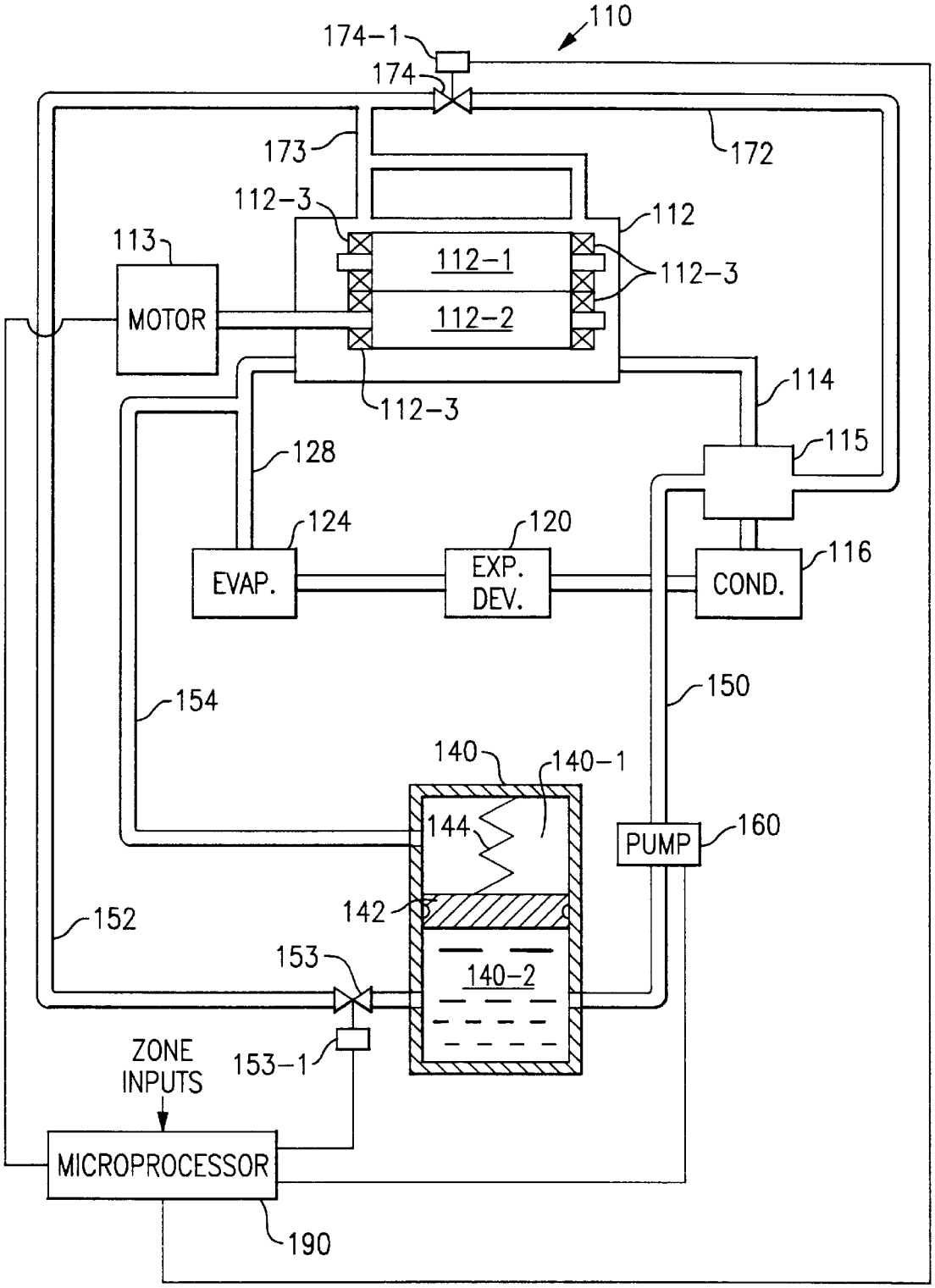
FIG. 2 is a schematic representation of a refrigeration system employing a second embodiment of the present invention.

If the compressor application requires very long periods of shutdown, then a possibility exists that the chamber 40-2 can become de-pressurized and pressure in chamber 40-1 can increase due to the effects of long term leakage across the piston 42 and through one-way valves 55 and 51, as well as solenoid valve 53. This potential problem is resolved by placing a small, inexpensive, positive displacement pump 160 in line 150 of system 110 under the control of microprocessor 190, as shown in FIG. 2. In FIG. 2 structure corresponding to structure in FIG. 1 has been number one hundred higher. The basic change in operation is that accumulator chamber 140-2, although isolated by closed solenoid valve 153 and pump 160, is not maintained pressurized during shutdown. Pump 160 will be activated by microprocessor 190 prior to the compressor start up to increase the pressure and amount of oil in the chamber 140-2 such that sufficient preloading of spring 140 takes place to provide a sufficient delivery of oil from chamber 140-2 via lines 152 and 173 to bearings 112-3 when solenoid valve 153 is opened. The oil supplied to chamber 140-2 will be delivered by pump 160 from the oil separator 115 via line 150 and pump 160 will normally be operated until the compressor 112 starts its normal operation. If the pump 160 is added to the circuit, there is no need to have one-way valves 55 and 51 in system 110 of FIG. 2. Otherwise, the structure of system 110 is the same as that of system 10 and accumulator 140 delivers pre-start lubrication in the same manner when solenoid 153 is opened. The advantages of using a small oil pump 160 in conjunction with an accumulator 140 is the reduction in size and cost of pump 160 as compared to a larger and more expensive pump that is used without the accumulator—i.e. the current art. The reduction in size and cost is accomplished using the dedicated accumulator that can be pre-charged using a small, low flow rate pump prior to the start up. The smaller pump can be utilized in this case because the required flow rate to pre-charge the accumulator is much smaller than the required flow rate that the dedicated pump must deliver to lubricate the bearings upon the start up.

Although preferred embodiments of the present invention have been illustrated and described, other changes will occur to those skilled in the art. For example, although a screw compressor has been specifically disclosed, the present invention may be employed with other positive displacement compressors. It is therefore, intended that he scope of the present invention is to be limited only by the scope of the appended claims.

What is claimed is:

1. In a refrigeration system having a compressor with components supported by bearings, a lubrication system which receives lubricant from one portion of the refrigeration system and delivers lubricant to the bearings, and an accumulator fluidly connected to the lubrication system, a method of providing lubrication to the bearings during start up of the refrigeration system including the steps of:

fluidly isolating lubricant in the accumulator as part of shutting down the refrigeration system; and as part of starting up the refrigeration system providing fluid communication between the isolated lubricant in the accumulator and the lubrication system and thereby lubricating the bearings.

2. The method of claim 1 wherein isolated lubricant in the accumulator is maintained in a pressurized state during shutdown.

3. The method of claim 1 further including the step of increasing the pressure of the isolated lubricant as part of starting up the refrigeration system.

4. A refrigeration system including:

a compressor having components supported by bearings;

lubrication means for receiving lubricant from one portion of said refrigeration system and for delivering lubricant to said bearings;

an accumulator fluidly connected to said lubrication means;

means for fluidly isolating said accumulator when shutting down said refrigeration system; and means for fluidly connecting said accumulator to said bearings prior to start up of said refrigeration system.

5. The refrigeration system of claim 4 further including means for boosting the pressure of said lubricant in said accumulator.

6. The refrigeration system of claim 5 wherein said means for boosting the pressure includes a pump.

7. The refrigeration system of claim 4 further including means for maintaining said lubricant isolated in said accumulator in a pressurized state.

* * * * *